US005275033A

United States Patent [19]

Riviere

[11] Patent Number: 5,275,033

[45] Date of Patent: Jan. 4, 1994

[54] METAL CAN BODY SHAPING INSTALLATION

[75] Inventor: Maruice Riviere, Bois D'Arcy, France

[73] Assignee: Carnaudmetalbox, Paris, France

[21] Appl. No.: 977,798

[22] Filed: Nov. 17, 1992

[30] Foreign Application Priority Data

Nov. 19, 1991 [FR] France ..... 91 14213

[51] Int. Cl.[5] ..... B21D 26/02

[52] U.S. Cl. ..... 72/62; 72/419; 198/376

[58] Field of Search ..... 72/57, 58, 60, 61, 62, 72/63, 361, 419; 198/394, 395, 376

[56] References Cited

U.S. PATENT DOCUMENTS

| | | | |
|---|---|---|---|
| 2,972,971 | 2/1961 | Hillgren . | |
| 3,220,235 | 11/1965 | Peccerill | 72/62 |
| 3,576,247 | 4/1971 | Caulford | 198/394 |
| 3,580,380 | 5/1971 | Phillips | 198/376 |
| 3,807,209 | 4/1974 | Aschberger et al. | 72/63 |
| 3,857,265 | 12/1974 | Howeler et al. | 72/63 |
| 4,110,493 | 8/1978 | Loveless et al. | 198/394 |
| 4,143,754 | 3/1979 | Eldred | 198/394 |
| 4,974,439 | 12/1990 | Saunders et al. | 72/361 |
| 5,058,724 | 10/1991 | Hinton | 198/376 |

FOREIGN PATENT DOCUMENTS

| | | |
|---|---|---|
| 349337 | 1/1990 | European Pat. Off. . |
| 3716176 | 9/1988 | Fed. Rep. of Germany . |
| 982808 | 2/1965 | United Kingdom . |
| 2224965 | 5/1990 | United Kingdom . |

*Primary Examiner*—Daniel C. Crane
*Assistant Examiner*—Michael J. McKeon
*Attorney, Agent, or Firm*—Sughrue, Mion, Zinn, Macpeak & Seas

[57] ABSTRACT

In a hydraulic method and installation for shaping can bodies the can body is filled with a liquid and placed in a die and pressure is applied to the interior of said can body until it assumes the shape of said die.

12 Claims, 3 Drawing Sheets

40
34
21
56
55b
55a
47
20
27
43
44
26
64
65
66
62
60
42
58

METAL CAN BODY SHAPING INSTALLATION

BACKGROUND OF THE INVENTION

1. Field of the Invention

The invention concerns a method of cold shaping a metal can body and a can body shaping installation adapted to implement it.

2. Description of the Prior Art

One prior art can shaping method is usually applied to can bodies assembled from at least two components, typically a tubular part and a bottom crimped to one end thereof. The tubular part may be a cylinder of circular, rectangular or square cross-section. This method uses a mechanism forming a core adapted to be inserted axially inside the can body through the opening thereof and having sectors adapted to be moved apart in the radially outward direction until they contact the inside wall of the can body to be shaped. This deforms the can body permanently and the resulting shape depends on the shape of the core sectors. In a system of this kind the deforming means and the actuating system thereof are essentially mechanical. Cans shaped in this way have shortcomings in respect of their appearance which are inherent to the shaping system itself. In particular, the imprints of the various sectors are visible on the can body walls. This means that the latter cannot have a perfectly regular surface. These imprints may even cause scoring of the varnish and lead eventually to corrosion. They may also lead to rupturing of the can. Additionally, the mechanism is complex and costly.

SUMMARY OF THE INVENTION

The invention proposes a simpler and more effective new method enabling the surface state and the general appearance of the shaped can body to be significantly improved and high rates of throughput to be achieved in production.

In one aspect, the present invention consists in a method of shaping a metal can body by filling said can body at least partially with a liquid so as to leave only a residual volume adjoining an opening at the upper end of said can body, inserting said can body in a die having substantially the shape to be imparted to said can body, applying pressure in said residual volume so that said can body is deformed into contact with said die and extracting said can body from said die.

On leaving the die the shaped can body is usually emptied of the liquid that it contains and transferred to an oven or like drying means. The liquid may be water. However, this shaping phase can be used to apply a protective internal coating to the walls of the can body. All that is required is to add to the liquid a protective agent adapted to leave a protective film on said walls after the can body is emptied and dried.

By virtue of another advantageous feature of the invention, an axial force may be applied to the can body while pressure is applied to said residual volume to favor the "movement" of the metal which is pressed against the inside walls of the die. This avoids exaggerated thinning of the metal in certain critical deformation areas.

In another aspect, the invention consists in an installation for shaping metal can bodies essentially comprising a station for filling at least one can body provided with means for introducing a required quantity of liquid into said at least one can body, a shaping station on the downstream side of said filling station comprising at least one die adapted to receive a can body and shaped internally according to the required shape to be imparted to said can body and a connector adapted to be sealed to the opening of said can body and connected to a pressurized fluid supply.

In an installation of this kind the conveyor, which extends from the filling station to the shaping station, may advantageously comprise bases each having a shape adapted to receive a can body. Each base is inserted into the lower part of the die which to this end comprises two lateral half-shells which are adapted to be moved apart and then closed onto a can body filled with liquid and on the point of being shaped in the manner indicated hereinabove. In an arrangement of this kind the aforementioned connector may advantageously comprise an axially sliding plug shaped to provide a sealed fit to the opening of the can body trapped in the die. The plug is loaded during the can body shaping phase to apply thereto the axial force mentioned above.

The invention will be better understood and other advantages of the invention will emerge more clearly from the following description of an installation in accordance with the invention given by way of example only with reference to the appended drawings.

DETAILED DESCRIPTION OF THE INVENTION

Figure 1:
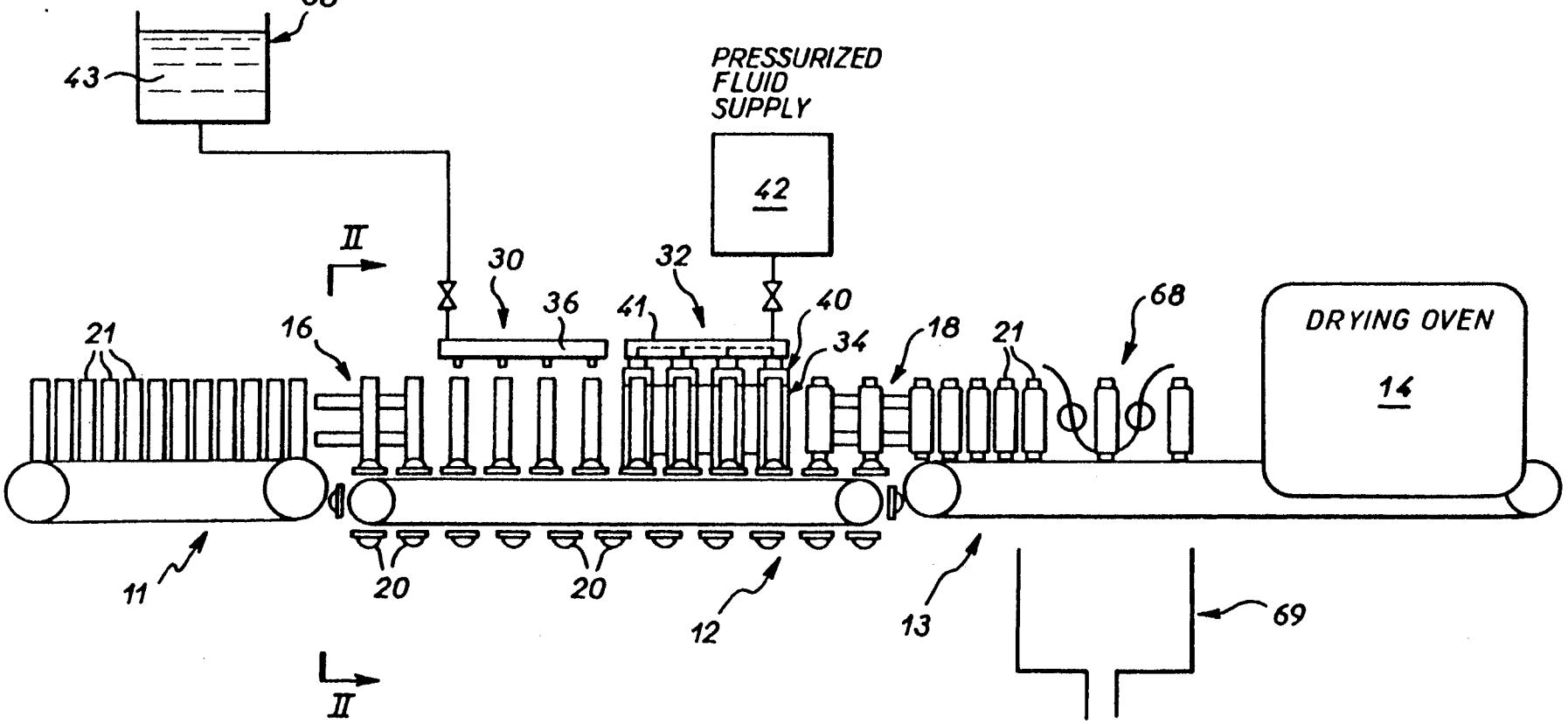
FIG. 1 is a diagrammatic general view of the installation.

The installation shown in the drawings comprises in succession a feed conveyor 11 onto which are placed the can bodies to be shaped, a main conveyor 12 along which the main processing stations are arranged, a transfer conveyor 13 and a drying oven 14. The transfer conveyor 13 is installed between the outlet of the main conveyor 12 and the outlet of the oven 14. A sequentially operated feed carousel 16 is installed between the feed conveyor and the main conveyor. A similar offtake carousel 18 is installed between the main conveyor and the transfer conveyor. All the components described so far are known in themselves. However, the main conveyor is provided with bases 20 each of which has a shape adapted to receive a can body. The feed carousel and main conveyor drive means are synchronized so that each can body 21 taken up by said feed carousel is put down on a base. To facilitate such transfer the bases 20 are made from a magnetic material which facilitates the placing of steel can bodies.

Figure 2:
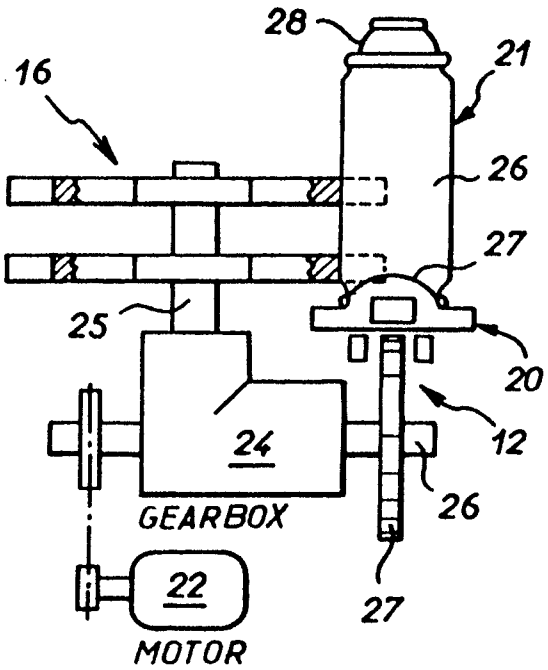
FIG. 2 is a more detailed diagrammatic view in cross-section on the line II—II in FIG. 1.

Referring to FIG. 2, synchronization is achieved by virtue of the fact that the feed carousel 16 and the main conveyor 12 are driven by a common motor 22 via a gearbox 24 comprising two perpendicular output shafts, a shaft 25 driving the carousel and a shaft 26 driving a drive wheel 27 of said main conveyor.

In this example the can bodies 21 are adapted to contain products to be sprayed in aerosol form. A can body of this kind conventionally comprises a circular cross-section cylinder 26, a bottom 27 crimped to this cylinder and a cap 28 crimped to the upper part of the cylinder and adapted to receive a sprayer device. To customize the packaging a particular shape is imparted to the can body, specifically by modifying the shape of the cylinder. Of course, this is merely one example of application of the general principle of the invention, which can be adapted to impart any required shape to any type of can body.

Along the main conveyor are disposed in succession a station 30 for filling at least one can body and a shaping station 32 on the downstream side of said filling station and comprising at least one die 34 (FIG. 5) adapted to receive a can body. In this example the filling station comprises a manifold 36 connected to a liquid supply tank 38 adapted to feed four can bodies simultaneously and the shaping station is equipped with four dies 34. The filling station includes means for introducing a required quantity of liquid such as water for example into each can body. Each die 34 is shaped internally according to the final shape to be imparted to the can body. Each die has a connector 40 which can make a sealed fit to the opening of the can body and this connector is connected to a pressurized fluid supply 42. The fluid may be a liquid or even air.

Figure 4:
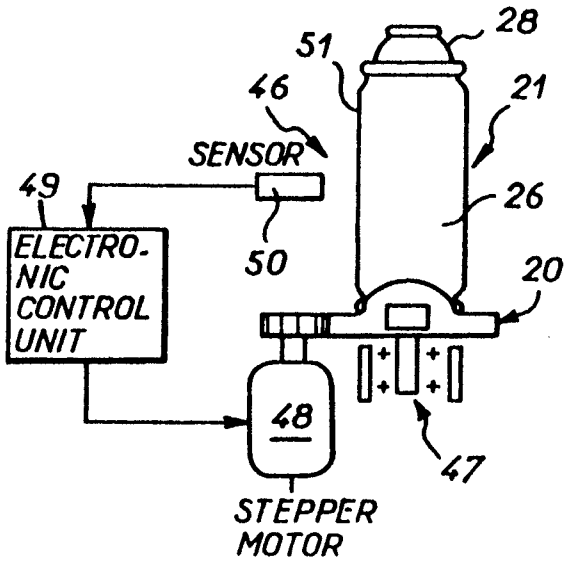
FIG. 4 is a diagrammatic view of the can body orienting device.
Figure 3:
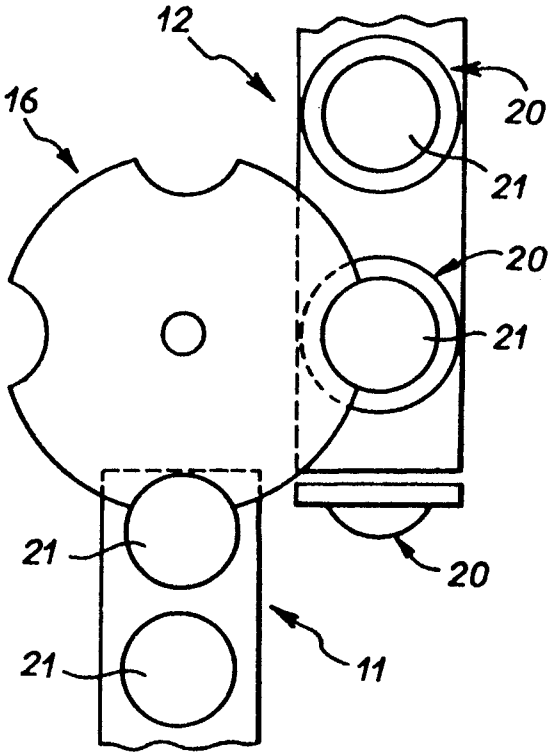
FIG. 3 is a top view of FIG. 2.

In this example the four connectors 40 are fastened to a common vertically mobile unit 41 and connected to the pressurized fluid supply 42. The liquid 43 fed into the can bodies at the filling station 30 is usually water but this liquid may have added to it a protective agent adapted to form a coating on the inside walls of the can body after it is emptied and dried. The quantity of liquid 43 fed into each can body at the filling station is determined according to the can body type so that there remains only a relatively small residual volume 44 adjoining the opening at the top of the can body. Each base 20 can pivot about a main axis of symmetry coincident with that of the can body just placed on said base. The installation is completed by a can body orienting station 46 here combined with the filling station, in other words it is on the downstream side of the shaping station. This orienting station comprises means for turning the base to bring the can body into a predetermined position as shown in FIG. 4. Note that each base 20 rotates on a ball bearing 47 and is coupled during filling to a stepper motor 48 controlled by an electronic unit 49 connected to a sensor 50 facing the can body. This sensor is responsive to a particular feature of the can body, a longitudinal seam weld 51 in this example. The electronic unit operates the motor 48 until said weld is in an accurately determined position defined by the location of the sensor 50. This orienting of the can body has several advantages. In any event, it enables the weld to be positioned so that, if it has any significant additional thickness, this can be caused to coincide with a longitudinal groove in the die. Additionally, if the shape to be imparted to the can body is not symmetrical with respect to its main axis, this orienting can serve to position decor silkscreened onto the surface of the can body relative to a particular feature in relief resulting from the shaping operation. The can body orienting means could be different than those shown and consist, for example, in a mechanism adapted to reorient each can body mounted on a non-pivoting base.

Figures 5, 6, 7:
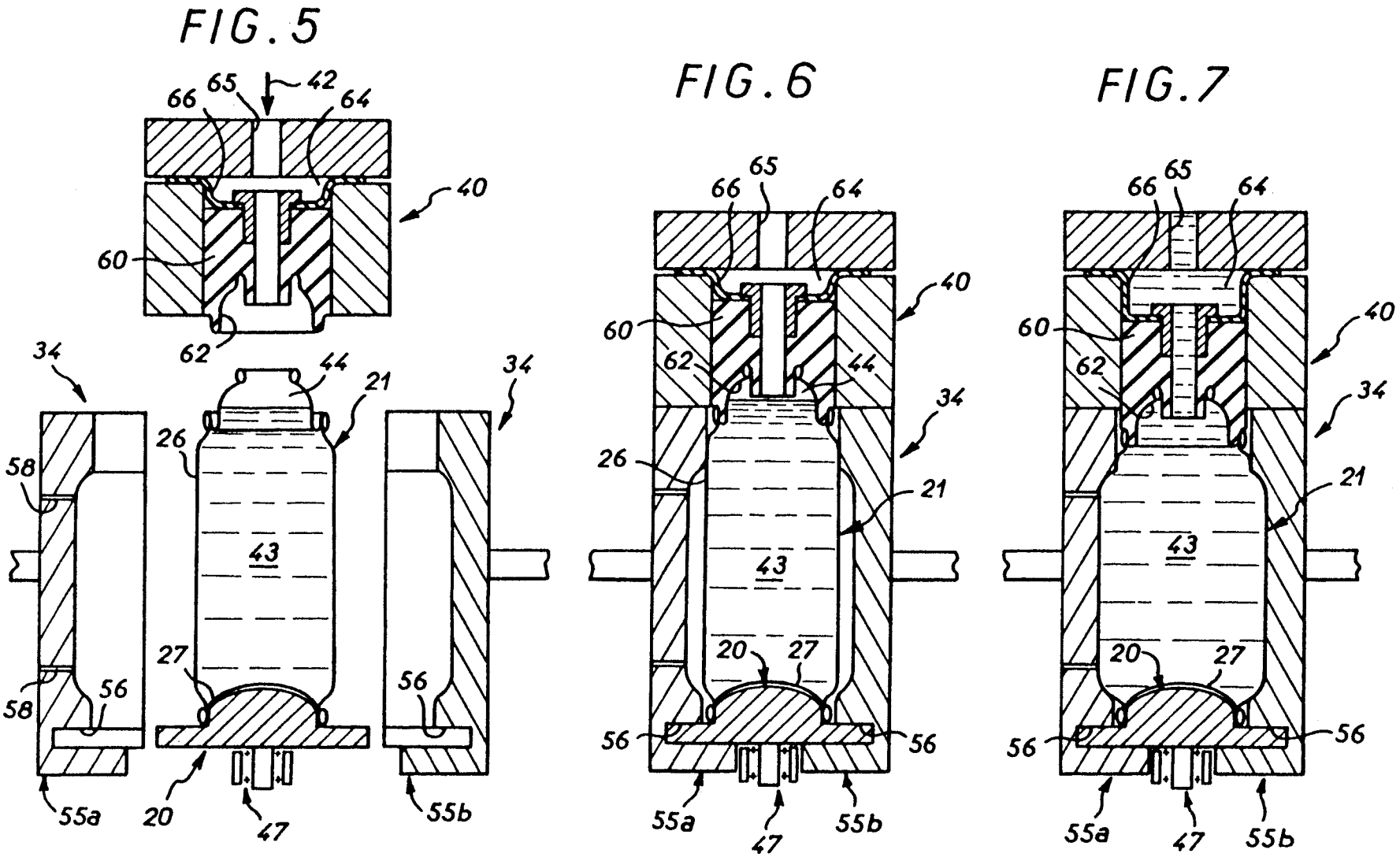
FIG. 5 is a diagrammatic view of the various parts of a die about to be closed on a can body.
FIG. 6 is a view similar to FIG. 5 showing the die enclosing a can body which is about to be shaped.
FIG. 7 is a view similar to FIG. 6 showing the same items after said can body is shaped.

Referring to FIGS. 5 through 7, each die comprises two lateral half-shells 55*a*, 55*b* operated by horizontal jacks (not shown). The two half-shells are adapted to move away from each other. At their lower ends they have semi-circular recesses 56. These recesses are shaped so that said half-shells can fit around a base as mentioned above. In the configuration with the two half-shells in contact with each other around a can body (FIG. 6), the base 20 of the main conveyor constitutes the bottom of the die. Each connector 40 fits to an opening at the top of the die so that pressurized fluid can be injected into the residual space above the liquid filling the can body to deform said body until it contacts the inside wall of the die 34, producing the required shape. Vent holes 48 are provided in the wall of one half-shell to enable escape of air trapped between the die and the can body during this shaping phase.

Additionally, each connector 40 comprises an axially slidable plug 60 having an application side 62 adapted to fit in a sealed manner to the opening of the can body trapped in the die. In this example this application side has a shape substantially reproducing the outline of the cap so that said sliding plug 60 is applied to substantially all of the surface of the can body cap. The plug includes a bore to enable pressurized fluid to be introduced. The connector further comprises means for forcibly applying the plug to the can body opening. To be more precise, the connector comprises a pressure chamber 64 with a mobile wall at least part of which is formed by the upper side of the sliding plug, opposite the application side thereof. The pressure chamber communicates with a pressurized fluid supply which in this example is the pressurized fluid supply 42 for shaping the can body. To this end the pressure chamber 64 is coaxial with the pressurized fluid inlet pipe 65 and communicates with it. A flexible fluid-tight membrane 66, made from an elastomer material in this example, is interleaved into said pressure chamber to separate the sliding plug 60 from fluid admitted into the chamber. Thus when pressure is applied to said residual space in the can body a force is exerted at the same time on the sliding plug 60 and therefore on the can body along its longitudinal axis. This enables the metal in the upper part of the cylinder 26 to be pushed down as the latter deforms radially outwards to contact the inside walls of the die. This prevents localized thinning and weakening of the cylinder wall at the places where its deformation is most accentuated. At the end of this operation the situation is that shown in FIG. 7. The mobile parts of the die are again moved to release the four shaped can bodies, which are then moved onto the transfer conveyor by the offtake carousel 18. Along this conveyor, and on the upstream side of the drying oven, the shaped can bodies pass through an emptying station 68 which is known in itself and which manipulates the can bodies to tip out the liquid that they contain. This liquid is recovered in a tank 69 and if appropriate recycled to the filling means (to be more precise to the tank 38), especially if it contains a protective agent. Finally, when the can bodies are empty they are passed through the drying oven 14 before they are transferred to other processing stations.

There is claimed:

1. An installation for shaping metal can bodies, comprising:

a station, for filling at least one can body, provided with means for introducing a required quantity of liquid directly into said at least one can body;

a shaping station, on the downstream side of said filling station, comprising at least one die adapted to receive a can body and shaped internally according to the required shape to be imparted to said can body; and a conveyor extending at least between a point on the upstream side of said filling station and a point on the downstream side of said shaping station, said conveyor comprising bases each having a shape adapted to receive a can body;

wherein said at least one die comprises two lateral half-shells which are adapted to be moved apart and which are provided near lower ends thereof with recesses shaped so that said half-shells can be fitted around a base; and wherein a fluid connector, adapted to be sealed to an opening of said can body and connected to a pressurized fluid supply, is shaped to fit at one upper opening of said die at said shaping station, whereby pressurized fluid is fed into said can body at said shaping station.

2. Installation according to claim 1 further comprising can body orienting means.

3. Installation according to claim 1 wherein said bases are made from a magnetic material.

4. Installation according to claim 1 wherein each said base is adapted to pivot about a main axis of symmetry coincident with that of said can body and further comprising a can body orienting station on the upstream side of said shaping station and means for rotating said base in order to place said can body in a predetermined position.

5. The installation according to claim 1 wherein said connector comprises an axially slidably plug having an application side shaped to fit and be sealed to the opening of a can body trapped in said die and a bore to enable introduction of pressurized fluid and further comprising means for axially forcibly applying said plug on said can body.

6. Installation according to claim 5 wherein said connector comprises a pressure chamber having a mobile wall formed at least in part by a side of said sliding plug opposite said application side thereof.

7. Installation according to claim 6 wherein said pressure chamber communicates with said pressurized fluid supply.

8. Installation according to claim 7 wherein a flexible sealed membrane is disposed in said pressure chamber to separate said sliding plug from fluid admitted into said chamber.

9. Installation according to claim 8 wherein said membrane is made from an elastomer material.

10. The installation according to claim 1 wherein said liquid contains a protective agent adapted to form a coating on the inside wall of said can body.

11. An installation for shaping metal can bodies, comprising a station for filling at least one can body and provided with means for introducing a required quantity of liquid into said at least one can body, a shaping station, located on the downstream side of said filling station, comprising at least one die adapted to receive a can body and shaped internally according to the required shape to be imparted to said can body, and a connector adapted to be sealed to an opening of said can body and connected to a pressurized fluid supply;

said installation further comprising a conveyor extending at least between a point on the upstream side of said filling station and a point on the downstream side of said shaping station, said conveyor comprising bases each having a shape adapted to receive a can body;

wherein said at least one die comprises two lateral half-shells adapted to be moved apart and provided near their lower ends with recesses shaped so that said half-shells can be fitted around a base and so that said connector fits to the end of an upper opening of said die;

wherein said connector comprises an axially slidably plug having an application side shaped to fit and be sealed to the opening of a can body trapped in said die and a bore to enable introduction of pressurized fluid, and further comprising means for forcibly applying said plug to the opening of said can body;

wherein said connector comprises a pressure chamber having a mobile wall formed at least in part by a side of said sliding plug opposite said application side thereof;

wherein said pressure chamber communicates with said pressurized fluid supply; and wherein a flexible sealed membrane is disposed in said pressure chamber to separate said sliding plug from fluid admitted into said chamber.

12. The installation according to claim 11 wherein said membrane is made from an elastomer material.

* * * * *